US006075757A

United States Patent [19]

Kawata

[11] Patent Number: 6,075,757

[45] Date of Patent: Jun. 13, 2000

[54] THERMOELECTRICALLY OPERATED TIMEPIECE

[75] Inventor: Masayuki Kawata, Chiba, Japan

[73] Assignee: Seiko Instruments Inc., Japan

[21] Appl. No.: 08/918,287

[22] Filed: Aug. 25, 1997

[30] Foreign Application Priority Data

Sep. 10, 1996 [JP] Japan ..... 8-239541
Jul. 28, 1997 [JP] Japan ..... 9-201902

[51] Int. Cl.[7] ..... G04C 3/00; G04B 37/00

[52] U.S. Cl. ..... 368/204; 368/281

[58] Field of Search ..... 368/64, 66, 203–205, 368/88, 276, 281; 320/2, 61; 136/205, 211, 212

[56] References Cited

U.S. PATENT DOCUMENTS 5,517,468 5/1996 Inoue et al. ..... 368/64
5,705,770 1/1998 Ogasawara et al. ..... 368/203

FOREIGN PATENT DOCUMENTS 2310589 5/1976 France .
2425664 5/1979 France .
1520193 8/1978 United Kingdom .
2020863 11/1979 United Kingdom .

OTHER PUBLICATIONS

Patent abstracts of Japan, vol. 096, No. 006 Jun. 28, 1996.

*Primary Examiner*—Vit Miska
*Attorney, Agent, or Firm*—Adams & Wilks

[57] ABSTRACT

A heat input means 54 for absorbing heat from a human body with which the timepiece is in contact, a thermally conductive elastic member 53 for conducting heat absorbed by the heat input means 54 to a thermal energy input side of a thermoelectric generator means 52, and a thermally conductive means 51 for conducting heat between a thermal energy output side of the thermoelectric generator means 52 and a heat output means 50. The heat output means 50 and the heat input means 54 are spaced widely from each other.

10 Claims, 4 Drawing Sheets

THERMOELECTRICALLY OPERATED TIMEPIECE

BACKGROUND OF THE INVENTION

The present invention relates to a thermoelectrically operated timepiece.

The cross-sectional configuration of the prior art thermoelectrically operated timepiece is shown in FIG. 4.

In FIG. 4, a movement 30 is thermally insulated from a cold bezel 31 and from a hot casing bottom portion 32 by a frame portion 37 via a metal ring 38.

Plastic rings 33 and 34 support the movement 30 and thermally insulate a thermoelectric generator 36 located between the casing bottom portion 32 and the cold metal ring 35.

Such a structure is disclosed, for example, in Unexamined Patent No. 13279/1990.

In the prior art thermoelectrically operated timepiece, heat is dissipated from the cold bezel 31 and from the cold metal ring 38 via the metal ring 35 on the cold side of the thermoelectric generator. Therefore, the frame portion 37 tries to provide heat insulation between the casing bottom 32 and the metal ring, but heat is transmitted to the metal ring located near the thermoelectric generator. The result is that the efficiency of the heat dissipation is low.

SUMMARY OF THE INVENTION

Accordingly, it is an object of the present invention to solve the foregoing problem with the prior art technique. For this purpose, a thermally conductive plate made of a material having a high thermal conductivity is mounted on the output side of a thermoelectric device from which thermal energy is taken. This thermally conductive plate is placed on the top surface of a case body and in direct contact with a heat-dissipating frame made of a material having a high thermal conductivity. Thus, heat can go into and out of the thermoelectric generator with high efficiency.

The above problem is solved by a structure comprising a heat input means for absorbing heat from a human body with which this structure is in contact, a thermally conductive elastic member for conducting heat absorbed by the heat input means to a thermal energy input side of a thermoelectric generator means, and a thermally conductive means for conducting heat between a heat energy output side of the thermoelectric generator means and a heat output means. The heat output means and the heat input means are spaced widely from each other.

DETAILED DESCRIPTION OF THE PREFERRED EMBODIMENTS

Figure 1:
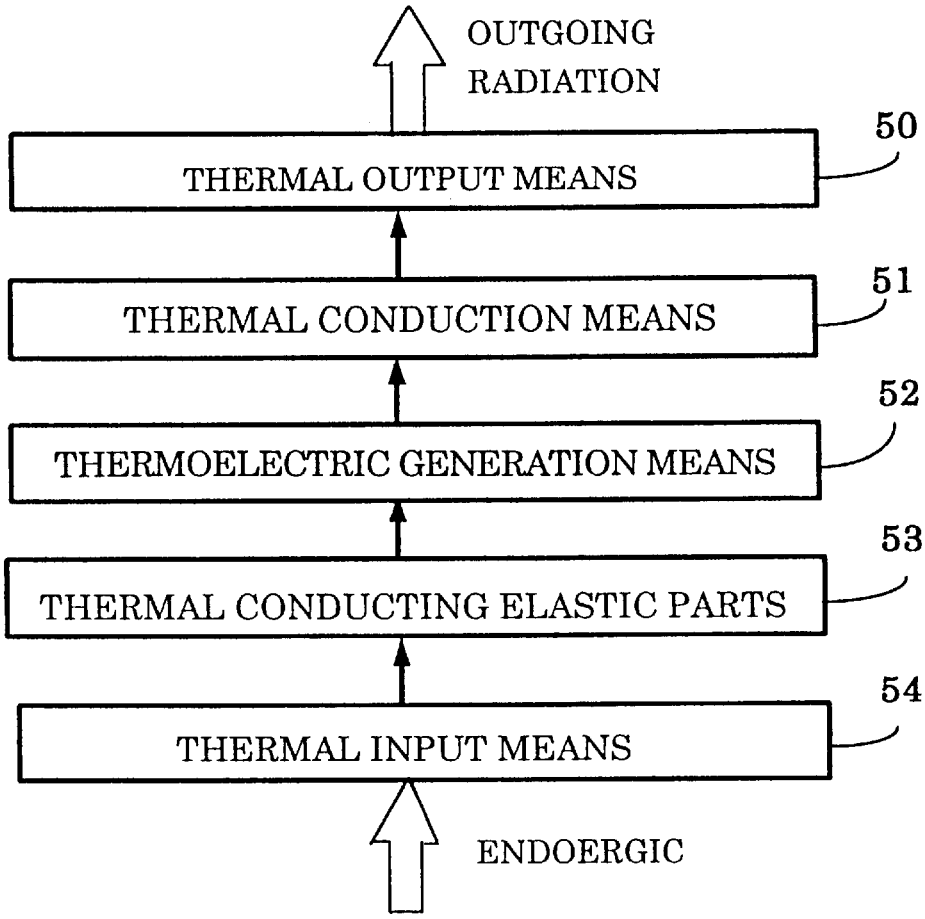
FIG. 1 is a functional block diagram of a thermoelectrically operated timepiece in accordance with the present invention.

FIG. 1 is a functional block diagram of a thermoelectrically operated timepiece in accordance with the present invention.

In FIG. 1, thermal input means 54 absorbs heat from a human body with which the timepiece is in contact. A thermally conductive elastic member 53 conducts the heat absorbed by the heat input means 54 to the heat energy input side of a thermoelectric generator means 52. A thermal conduction means 51 provides heat conduction between the thermal energy output side of the thermoelectric generator means 52 and thermal output means 50.

Embodiments of this invention are hereinafter described with reference to the attached drawings.

Figure 2:
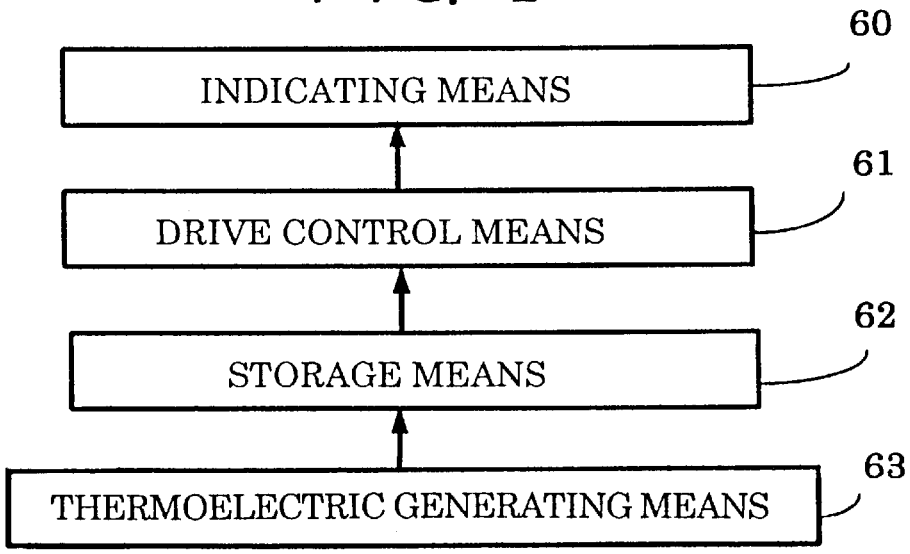
FIG. 2 is a functional block diagram illustrating the principle of operation of a thermoelectrically operated timepiece in accordance with the invention.

FIG. 2 is a functional block diagram showing the principle of operation of a thermoelectrically operated timepiece in accordance with the present invention.

In FIG. 2, the timepiece comprises a thermoelectric generation means 63 for receiving heat from a human body with which the timepiece is contacted and converting the heat into electricity, an electricity storage means 62 for storing the electricity converted by the thermoelectric generation means 63, an operation or drive control means 61 powered by the electric power stored in the electricity storage means 62, and an indicating means 60 for displaying the time or the like under control of the operation control means 61.

Figure 3:
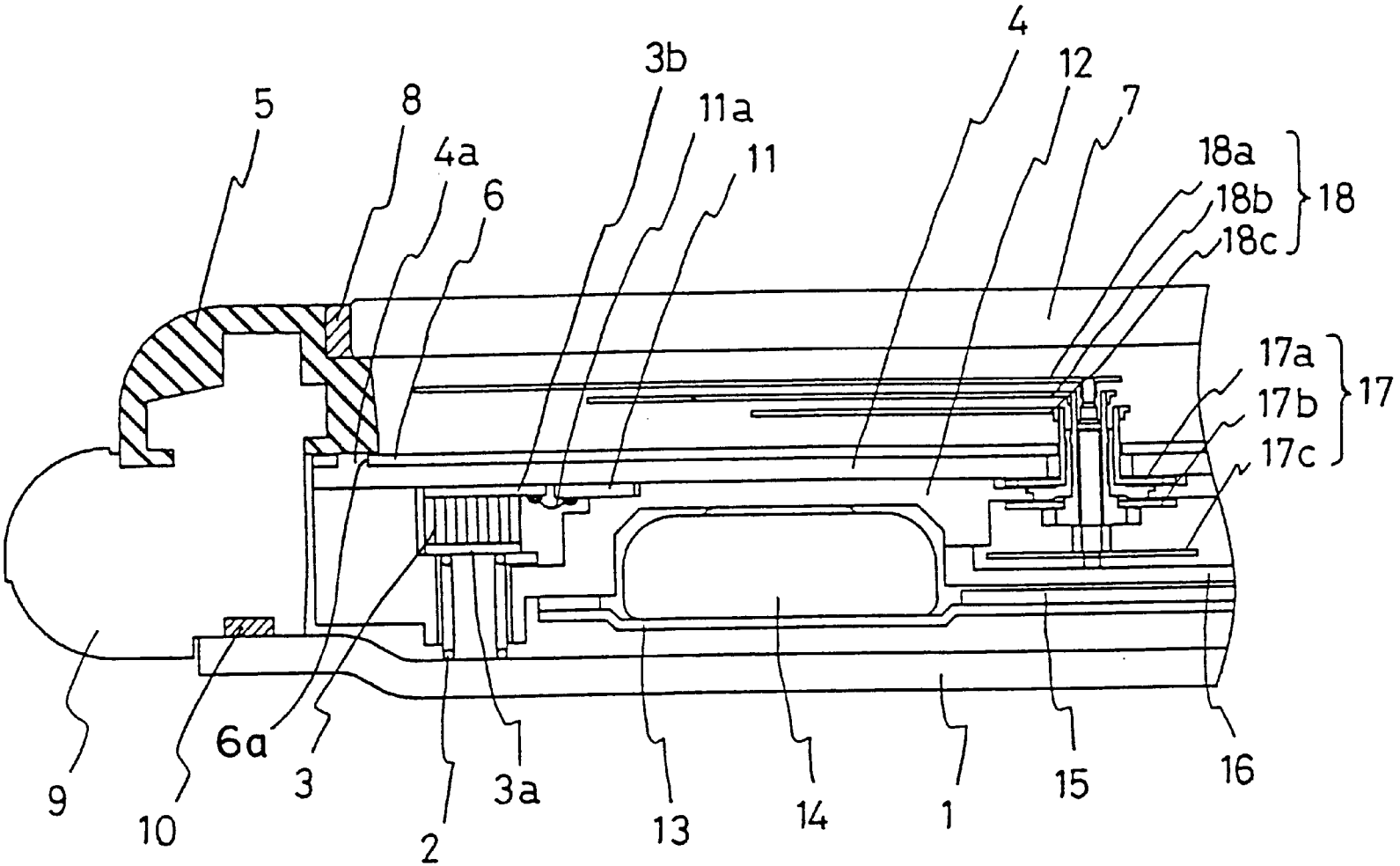
FIG. 3 is a cross-sectional view showing the configuration of a thermoelectrically operated timepiece in accordance with the invention.
Figure 4:
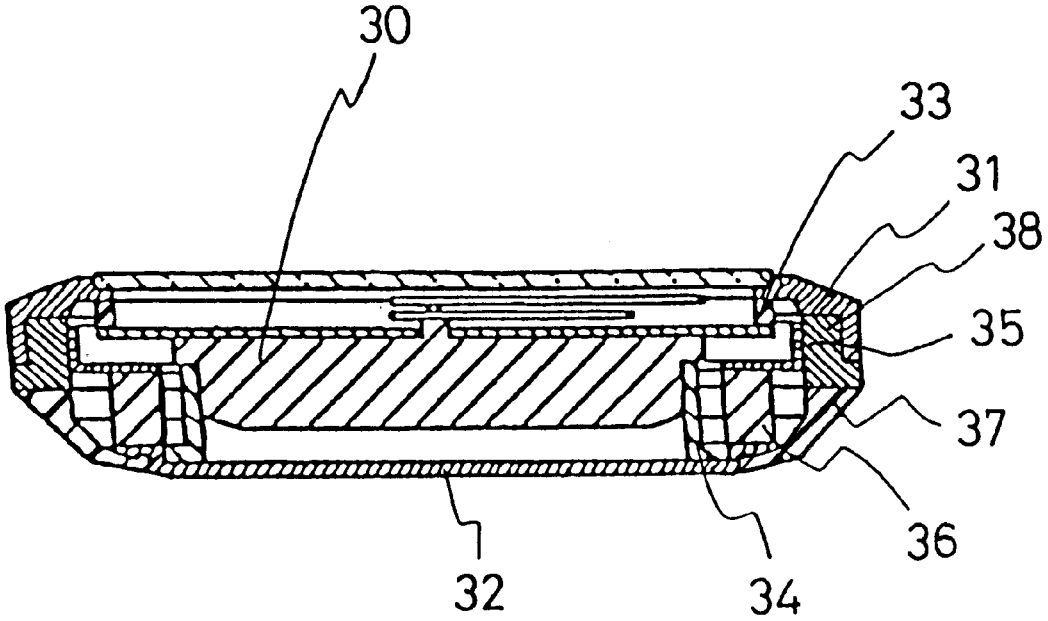
FIG. 4 PRIOR ART
FIG. 4 is a cross-sectional view of the prior art thermoelectrically operated timepiece.

FIG. 3 is a cross-sectional view showing the configuration of a thermoelectrically operated timepiece in accordance with the present invention. In FIG. 3, there is provided a rear cover 1 that is a heat or thermal input means. A rear cover packing 10 is held between the rear cover 1 and a case body 9 made of a thermoplastic resin, for example, that is effective in providing thermal insulation. A thermally conductive spring 2 that is a thermally conductive elastic member is made of a material having a high thermal conductivity such as aluminum or copper. One end of the thermally conductive spring 2 is in contact with the rear cover 1, while the other end is in contact with a first or heat input side portion 3*a* of a thermoelectric device 3 that is a thermoelectric generator means. The spring is held as shown by a main plate 12 made of a thermoplastic resin that is effective in providing heat insulation.

A second or heat output side portion 3*b*, or the other side of the thermoelectric device 3, is in contact with a thermally conductive plate 4 having a guide pin portion 4*a* on its outer surface. The thermally conductive plate 4 is a thermally conductive means that guides a dial 6, and the guide pin portion 4*a* extends upwardly in FIG. 3 through a hole 6*a* in the dial 6. A thermal ray-reflecting coating (not shown) is formed on the surface of the dial 6.

A heat-dissipating frame 5 is formed on the case body 9 by insert molding from a material having a high thermal conductivity such as aluminum or copper. The heat-dissipating frame 5 is is a heat output means and is treated with an anticorrosive and mounted on the case body 9. The heat-dissipating frame 5 hold a glass 7 via a glass packing 8, and the heat dissipating frame 5 is in direct contact with the guide pin portion 4*a* of the thermally conductive plate 4 through the hole 6*a* of the dial 6.

A printed circuit board 11 is in contact with one side (e.g., the heat output portion 3*b*) of the thermoelectric device 3 by a wire ll*a*. The printed circuit board 11 is electrically connected with a circuit block 15 fixed to the main plate 12.

Electric power generated by the thermoelectric device 3 is stored in a secondary battery 14 by the printed circuit board 11 under control of an electricity storage control circuit (not shown).

The circuit block 15 powered by the stored electric power activates a driving motor (not shown) to operate and control a hand wheel train 17 including a fourth wheel & pinion 17*a*, a second wheel & pinion 17*b*, and a hour wheel 17*c* that are held by a wheel train bridge 16 and the main plate 12.

Hands comprising a second hand 18a, a minute hand 18*b*, and a hour hand 18*c* are mounted to the hand wheel train 17 to display the time.

The secondary battery 14, the circuit block 15, and so on are made stationary by a holder 13. A space effective in providing thermal insulation between the rear cover 1 is secured.

Figure 5:
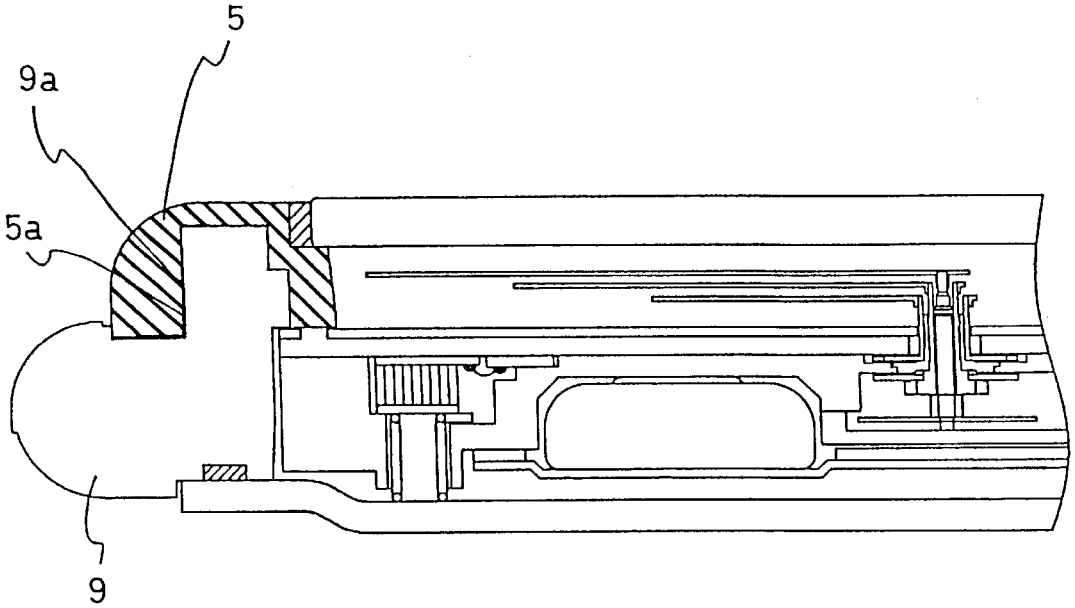
FIG. 5 is a cross-sectional view showing the configuration of another embodiment of the thermoelectrically operated timepiece in accordance with the invention.

FIG. 5 is a cross-sectional view showing another embodiment of a thermoelectrically operated timepiece in accordance with the present invention. In FIG. 5, the case body 9 made of a thermoplastic resin has an inclined surface portion 9*a* permitting a drive fit.

The heat-dissipating frame 5 has an inner inclined surface portion 5*a* that cooperates with the inclined surface portion 9*a* of the case body 9 to enable mounting with an interference. This embodiment is similar to Embodiment 1 in other respects.

As described thus far, the present invention comprises a heat input means for absorbing heat from a human body with which this structure is in contact, a thermally conductive elastic member for conducting heat absorbed by the heat input means to a thermal energy input side of a thermoelectric generator means, and a thermally conductive means for conducting heat between a thermal energy output side of the thermoelectric generator means and a heat output means. The heat output means and the heat input means are spaced widely from each other. Heat can be transferred into and out of the thermoelectric device efficiently. As a result, the efficiency of the thermoelectric conversion can be improved.

What is claimed is:

1. A thermoelectrically operated timepiece using electric power generated by a thermoelectric generator means as an energy source, the timepiece comprising:

heat input means for absorbing heat from a human body when in contact with the human body;

thermoelectric generator means for producing an output voltage in response to a temperature difference thereacross and having a first portion which receives heat absorbed by the heat input means and a second portion which is cooled by atmospheric temperature conveyed thereto by a case of the timepiece;

a first thermally conductive elastic member for conducting heat absorbed by the heat input means to the first portion of the thermoelectric generator means (52);

heat output means formed on the case of the timepiece and being in direct contact with the dial of the timepiece for cooling the second portion of the thermoelectric generator means; and a second thermally conductive member in direct contact with the second portion of the thermoelectric generator means, the dial of the tiempiece, and the heat output means for conducting heat between the second portoin of the thermoelectric generator means and the heat output means, so that the heat output means and the heat input means are spaced widely from each other within the timepiece.

2. The thermoelectrically operated timepiece of claim 1; wherein the heat output means is formed on or in the case of the timepiece by insert molding.

3. The thermoelectrically operated timepiece of claim 1; wherein the heat output means is mounted with a drive fit to the case of the timepiece.

4. The thermoelectrically operated timepiece of claim 1; wherein the thermally conductive member has a first surface in contact with the second portion of the thermoelectric generator means and a second surface in contact with the dial of the timepiece, and has a guide pin portion formed on the second surface to guide a dial, the guide pin portion being in contact with the heat output means.

5. The thermoelectrically operated timepiece of claim 1; wherein the thermally conductive elastic member is made of a material having a high thermal conductivity such as aluminum or copper.

6. The thermoelectrically operated timepiece of claim 1; wherein the heat output means is made of a material having a high thermal conductivity such as aluminum or copper.

7. The thermoelectrically operated timepiece of claim 1; wherein the dial guided by the guide pin portion of the thermally conductive member has a surface coating which reflects thermal radiation.

8. The thermoelectrically operated timepiece of claim 1; wherein the heat input means comprises a rear plate of the timepiece.

9. The thermoelectrially operated timepiece of claim 8; wherein the thermally conductive elastic member comprises a spring, a first end of which is in contact with the heat input means and a second end of which is in contact with the first portion of the thermoelectric generator means.

10. In a thermoelectrically operated timepiece, the combination comprising:

heat input means for absorbing heat from a human body when in contact with the human body;

a thermoelectric generator for producing an output voltage in response to a temperature difference thereacross and having a first portion which receives heat absorbed by the heat input means and a second portion which is cooled by atmospheric temperature conveyed thereto by a case of the timepiece;

a first thermally conductive elastic member for conveying heat absorbed by the heat input means to the first portion of the thermoelectric generator;

a second thermally conductive member in direct contact with the second portion of the thermoelectric generator; and heat output means formed on the case of the timepiece and in direct contact with the second thermally conductive member through a hole formed in a dial of the timepiece for cooling the second portion of the thermoelectric generator.

* * * * *